US012655853B2

(12) United States Patent
Zhang et al.

(10) Patent No.: US 12,655,853 B2
(45) Date of Patent: Jun. 16, 2026

(54) COMBINED FAN BLADE STRUCTURE AND AIR OUTLET DEVICE

(71) Applicant: XUXIN TECHNOLOGY (SHENZHEN) GROUP CO., LTD, Shenzhen (CN)

(72) Inventors: Ping Zhang, Shenzhen (CN); Sin Hin Wu, Shenzhen (CN); Xinglin Sun, Shenzhen (CN); Huizhu Zhou, Shenzhen (CN); Yelin Sun, Shenzhen (CN); Lanying Luo, Shenzhen (CN)

(73) Assignee: XUXIN TECHNOLOGY (SHENZHEN) GROUP CO., LTD., Shenzhen (CN)

( * ) Notice: Subject to any disclaimer, the term of this patent is extended or adjusted under 35 U.S.C. 154(b) by 0 days.

(21) Appl. No.: 18/901,262

(22) Filed: Sep. 30, 2024

(65) Prior Publication Data

US 2025/0020140 A1 Jan. 16, 2025

Related U.S. Application Data

(63) Continuation of application No. PCT/CN2023/084019, filed on Mar. 27, 2023.

(30) Foreign Application Priority Data

Apr. 18, 2022 (CN) ..... 202210405774.7

(51) Int. Cl.
*F04D 29/38* (2006.01)
*F04D 25/08* (2006.01)
*F04D 29/54* (2006.01)

(52) U.S. Cl.
CPC ..... *F04D 29/384* (2013.01); *F04D 25/08* (2013.01); *F04D 29/541* (2013.01)

(58) Field of Classification Search
CPC ..... F04D 25/064; F04D 25/16; F04D 25/384
See application file for complete search history.

(56) References Cited

U.S. PATENT DOCUMENTS 6,457,955 B1 * 10/2002 Cheng ..... F04D 25/066 165/122
9,745,984 B2 8/2017 Chang
10,082,305 B2 * 9/2018 Oh ..... F04D 29/281
(Continued)

FOREIGN PATENT DOCUMENTS

CN 104005993 A 8/2014
CN 107061324 A 8/2017
CN 209041173 U 6/2019
(Continued)

OTHER PUBLICATIONS

Image and machine translation.*
International Search Report and Written Opinion issued in corresponding PCT Application No. PCT/CN2023/084019, dated Jun. 12, 2023.
First Office Action issued in counterpart Japanese Patent Application No. 2024-558434, dated Sep. 16, 2025.
European Search Report issued in counterpart European Patent Application No. EP 23790987.4, dated Apr. 28, 2025.
(Continued)

*Primary Examiner* — Brian O Peters
(74) *Attorney, Agent, or Firm* — Westbridge IP LLC

(57) ABSTRACT

The combined fan blade structure includes: an inner hub, an outer hub, a first blade set, and a second blade set. The outer hub and the inner hub are coaxially arranged, the first blade set is connected to an outer peripheral surface of the outer hub, the second blade set is located between the inner hub and the outer hub, and the outer hub blocks the second blade set.

15 Claims, 7 Drawing Sheets

(56) References Cited

U.S. PATENT DOCUMENTS

| | | | |
|---|---|---|---|
| 2007/0031248 | A1 | 2/2007 | Hsu et al. |
| 2012/0020778 | A1 | 1/2012 | Ruck |

FOREIGN PATENT DOCUMENTS

| | | | | |
|---|---|---|---|---|
| CN | 212155257 | U | | 12/2020 |
| CN | 214945238 | U | | 11/2021 |
| CN | 114233680 | A | | 3/2022 |
| CN | 114704500 | A | | 7/2022 |
| CN | 217518915 | U | | 9/2022 |
| CN | 116292415 | A | | 6/2023 |
| CN | 219422386 | U | | 7/2023 |
| CN | 116576577 | A | | 8/2023 |
| CN | 117167301 | A | | 12/2023 |
| JP | S58162299 | U | | 10/1983 |
| JP | H01182598 | A | | 7/1989 |
| JP | H05106592 | A | | 4/1993 |
| JP | 2006226200 | A | | 8/2006 |
| JP | 2019504958 | A | | 2/2019 |
| TW | 1282392 | | * | 6/2007 |
| TW | 200928111 | A | | 7/2009 |
| WO | 2018074663 | A1 | | 4/2018 |

OTHER PUBLICATIONS

Expert Report issued in counterpart Chilean Patent Application No. 202403028, dated Oct. 13, 2025.

First Office Action issued in counterpart Australian Patent Application No. 2023258075, dated Jul. 14, 2025.

First Office Action issued in counterpart Chinese Patent Application No. 202210405774.7, dated Aug. 9, 2025.

First Office Action issued in counterpart Eurasian Patent Application No. 202492275, dated Dec. 4, 2024.

Notice of Reasons for Refusal issued in counterpart Japanese Patent Application No. 2024-558434, dated Jan. 6, 2026.

Notification to Grant Patent Right for Invention issued in counterpart Australian Patent Application No. 2023369075, dated Dec. 19, 2025.

Notification to Grant Patent Right for Invention issued in counterpart Eurasian Patent Application No. 202492275, dated Oct. 14, 2025.

Office Action issued in counterpart Brazilian Patent Application No. BR112024020537-1, dated Sep. 23, 2025.

Second Office Action issued in counterpart Eurasian Patent Application No. 202492275, dated Apr. 28, 2025.

* cited by examiner

COMBINED FAN BLADE STRUCTURE AND AIR OUTLET DEVICE

CROSS-REFERENCE TO RELATED APPLICATIONS

This application is a continuation application of International Application No. PCT/CN2023/084019, filed on Mar. 27, 2023, which claims priority to Chinese Patent Application No. 202210405774.7, filed on Apr. 18, 2022. The disclosures of the above-mentioned applications are incorporated herein by reference in their entireties.

TECHNICAL FIELD

The present disclosure relates to a combined fan blade structure and an air outlet device.

BACKGROUND

The statements herein merely provide background information related to the present disclosure and do not necessarily constitute the prior art.

In the technical field of fans, axial flow fans are usually used to meet the demand for high air volume delivery. The air volume of axial flow fans is increased by reducing the hub ratio that is the ratio of the hub diameter to the impeller diameter. However, the hub ratio of axial flow fans is limited. An excessively low hub ratio leads to reduced fan efficiency, making it difficult for the fan to balance the requirements for both high air volume and efficient air delivery.

SUMMARY

The present disclosure aims to solve at least one of the technical problems existing in the prior art. To this end, the present disclosure provides a combined fan blade structure and an air outlet device. Accordingly, the air volume and air outlet efficiency of the fan blade structure can be improved.

According to an embodiment in a first aspect of the present disclosure, the combined fan blade structure includes:

an inner hub;

an outer hub coaxially arranged with the inner hub and arranged around the inner hub;

a first blade set connected to an outer peripheral surface of the outer hub, where the first blade set includes a plurality of first blades, and the plurality of first blades are distributed at intervals in a circumferential direction of the outer hub; and a second blade set connected between the inner hub and the outer hub and including a plurality of second blades, where the plurality of second blades are distributed at intervals in a circumferential direction of the inner hub, and the outer hub blocks sides of the second blades facing the outer hub.

According to an embodiment of the present disclosure, the combined fan blade structure has at least the following beneficial effects.

In the combined fan blade structure provided in an embodiment of the present disclosure, the first blade set and the second blade set are respectively located on the inner and outer sides of the outer hub in the radial direction, and can both receive air entering from the external environment, making the combined fan blade structure have a large air inlet area. Both the first blade set and the second blade set can rotate the air from the air inlet side of the fan blade structure to form an airflow and discharge the airflow, thereby increasing the air volume of the fan blade structure. The first blade set allows a larger number of first blades to be connected, thereby increasing the air volume of the fan blade structure. The number of second blades is not affected by the size of the hubs and is not limited by the hub ratio, and the size of the inner hub is not limited. The airflows generated by the first blade set and the second blade set are combined and discharged. Compared with the traditional axial flow fan, the fan blade structure can generate a larger air volume at the same rotational speed, and requires a lower rotational speed when generating the same air volume, thereby improving the air volume and air outlet efficiency of the fan blade structure.

According to some embodiments of the present disclosure, the first blades include axial flow blades or oblique flow blades, and/or the second blades include centrifugal blades.

According to some embodiments of the present disclosure, the first blades are axial flow blades, and projections of adjacent first blades in a plane perpendicular to an axial direction are spaced in the circumferential direction; or, the first blades are oblique flow blades, and projections of adjacent first blades in a plane perpendicular to an axial direction have overlapping areas in the circumferential direction.

According to some embodiments of the present disclosure, the outer hub is inclined in a direction away from a rotation axis of the inner hub in an air outlet direction.

According to some embodiments of the present disclosure, the inner hub is inclined in the direction away from the rotation axis of the inner hub in the air outlet direction.

According to some embodiments of the present disclosure, the inner hub has an opening facing an air outlet side.

According to some embodiments of the present disclosure, the inner hub includes a first air guide portion and a second air guide portion connected to each other, the first air guide portion is located on an air inlet side of the inner hub, the second air guide portion is arranged opposite the outer hub in a radial direction of the outer hub, and the second blades are connected to the second air guide portion.

According to some embodiments of the present disclosure, the first air guide portion and/or the second air guide portion are inclined in the direction away from the rotation axis of the inner hub in the air outlet direction.

According to some embodiments of the present disclosure, an acute angle between the first air guide portion and the second air guide portion and the rotation axis of the inner hub gradually decreases in the air outlet direction.

According to some embodiments of the present disclosure, the first air guide portion is axially higher than an air inlet side of the outer hub.

According to some embodiments of the present disclosure, a distance between adjacent second blades in an inner circumferential direction of the outer hub is smaller than a distance between adjacent first blades in an outer circumferential direction of the outer hub.

According to some embodiments of the present disclosure, a hub ratio of the inner hub to the second blades is smaller than a hub ratio of the outer hub to the first blades.

An air outlet device according to an embodiment of a second aspect of the present disclosure includes:

the combined fan blade structure according to an embodiment in the first aspect;

an air deflector provided with an air inlet and an air outlet at both ends, where the air deflector has an air guide cavity inside, the air inlet and the air outlet are both communicated with the air guide cavity, and the combined fan blade structure is accommodated in the air guide cavity and coaxially arranged with the air deflector; and a power element connected to one end of the inner hub close to the air outlet and configured to drive the inner hub to rotate.

According to some embodiments of the present disclosure, the air outlet device further includes a mounting seat and a plurality of guide vanes, the mounting seat and the plurality of guide vanes are all accommodated in the air deflector, the mounting seat and the air deflector are coaxially arranged, one end of the power element connected to the inner hub passes through the mounting seat, the plurality of guide vanes are arranged around an outer periphery of the mounting seat, and the guide vanes are connected between the air deflector and the mounting seat.

According to some embodiments of the present disclosure, an outer wall of the mounting seat is located radially inward of an inner wall of the outer hub at one end close to the air outlet.

According to some embodiments of the present disclosure, the mounting seat includes a first connecting part, a second connecting part, and a transition part, where the first connecting part is perpendicular to the rotation axis of the inner hub, the second connecting part is arranged around an outer periphery of the first connecting part, the transition part is connected between the first connecting part and the second connecting part, and the transition part is inclined away from the rotation axis of the inner hub in the air outlet direction.

Additional aspects and advantages of the present disclosure will be elaborated in the description which follows, and will be partially apparent from the description, or understood by practice of the present disclosure.

BRIEF DESCRIPTION OF THE DRAWINGS

To better clarify the embodiments of the present disclosure or the technical solution in the prior art, the drawings required to illustrate the embodiments or the prior art will be simply described below. It is apparent that the drawings described below merely illustrate some embodiments of the present disclosure. Those of ordinary skill in the art can obtain other drawings according to these drawings without making creative efforts on the basis of those drawings.

DETAILED DESCRIPTION OF THE EMBODIMENTS

Figure 1:
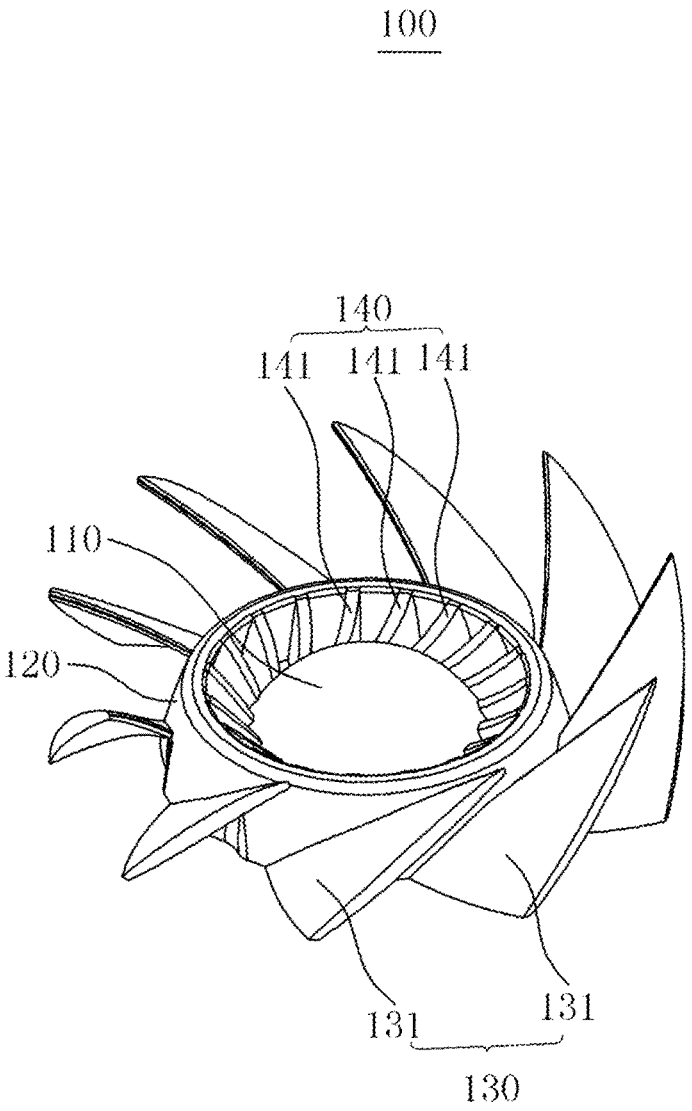
FIG. 1 is a schematic structural diagram of a combined fan blade structure according to some embodiments of the present disclosure.

The embodiments of the present disclosure are described in detail below, examples of which are shown in the drawings, the same or similar reference signs throughout indicate the same or similar components or components with same or similar function. The embodiments described with reference to the drawings are exemplary, which are merely used to explain the present disclosure, instead of being understood as a limitation to the present disclosure.

In the description of the present disclosure, it is understood that orientation or position relationships indicated by the terms "upper", "lower", "front", "rear", "left", and "right", and the like are based on the orientation or position relationships as shown in the drawings, for ease of describing the present disclosure and simplifying the description only, rather than indicating or implying that the mentioned apparatus or element necessarily has a particular orientation and must be constructed and operated in the particular orientation. Therefore, these terms should not be understood as limitations to the present disclosure.

In the description of the present disclosure, the meaning of "several" is one or more, the meaning of "a plurality" is two or more; "greater than", "less than", "exceeding" and the like are understood as excluding the original number, and "above", "below", "within" and the like are understood as including the original number. The described "first" and "second" are merely used for distinguishing technical features, instead of being understood as indicating or implying relative importance or impliedly indicating the quantity of the showed technical features or impliedly indicating the precedence relationship of the showed technical features.

In the description of the present disclosure, unless otherwise explicitly limited, the terms "set", "install", "connect" and the like should be generally understood. Those of ordinary skill in the art may reasonably determine the specific meaning of the terms in the present disclosure in combination with the specific contents of the technical solution.

In the description of the present disclosure, the description with reference to the terms "some embodiments", "schematic embodiment", "example", "specific example", or "some examples" and the like means that the specific characteristics, structures, materials or features described in combination with the embodiment or example are included in at least some embodiments or examples of the present disclosure. In this specification, the schematic expression of the above terms does not necessarily refer to the same embodiment or example. Moreover, the described specific characteristics, structures, materials or features may be combined in one or more embodiments or examples in a suitable manner.

Referring to FIGS. 1 to 4, an embodiment of the present disclosure provides a combined fan blade structure 100 (which may also be referred to as a combined air outlet structure, hereinafter referred to as the fan blade structure 100). The combined fan blade structure 100 includes an inner hub 110, an outer hub 120, a first blade set 130, and a second blade set 140. The inner hub 110 and the outer hub 120 are coaxially arranged. The outer hub 120 is arranged around the inner hub 110 with a gap between them. The first blade set 130 is located radially outside the second blade set 140. The first blade set 130 is connected to an outer peripheral surface of the outer hub 120, and the second blade set 140 is located between the inner hub 110 and the outer hub 120. Since the first blade set 130 and the second blade set 140 are respectively located on the inner and outer sides of the outer hub 120 in the radial direction and can both receive air entering from the external environment, making the combined fan blade structure 100 have a large air inlet area. Both the first blade set 130 and the second blade set 140 can rotate the air from the air inlet side of the fan blade structure 100 to form an airflow and discharge the airflow, thereby increasing the air volume of the fan blade structure 100.

Specifically, the first blade set 130 includes a plurality of first blades 131 distributed at intervals in the circumferential direction of the outer hub 120. The second blade set 140 includes a plurality of second blades 141 distributed at intervals in the circumferential direction of the inner hub 110. Both sides of the second blades 141 are respectively connected to the outer hub 120 and the inner hub 110 in a radial direction of the inner hub 110. The inner hub 110 may be connected to a power element and simultaneously drives the first blades 131 and the second blade set 140 to rotate and form an airflow. Specifically, the outer hub 120 blocks the sides of the second blades 141 facing the outer hub 120 to guide the airflow. An end of each of the second blades 141 close to the outer hub 120 may be partially connected to the outer hub 120, or may be completely connected to the outer hub 120. The plurality of first blades 131 and the plurality of second blades 141 are inclined in the same preset direction from the respective roots thereof connected to the outer hub 120. The preset direction may be clockwise or counterclockwise.

In addition, in some embodiments of the present disclosure, the first blades 131 are configured as axial flow blades or oblique flow blades, and the second blades 141 are configured as centrifugal blades. The number of centrifugal blades is not affected by the size of the hubs and is not limited by the hub ratio. To meet the design requirements of small hubs and multiple blades, the size of the inner hub 110 is not limited, and a small inner hub 110 may be designed. Compared with simply configuring axial flow blades, configuring the second blades 141 as centrifugal fan blades can increase the number of second blades 141, which is conducive to increasing the air volume. Moreover, the outer hub 120 blocking the sides of the second blades 141 facing the outer hub 120 can guide out the airflow generated by the second blades 141 in the axial direction of the fan blade structure 100, so that the second blade set 140 discharges air axially. The first blade set 130 can generate an axial or oblique airflow. Since the first blade set 130 is connected to the outer hub 120 which has a larger size and thus allows a larger number of first blades 131 to be connected, the air volume of the fan blade structure 100 can be increased. The airflows generated by the first blade set 130 and the second blade set 140 are discharged after combined. Compared with the traditional axial flow fan, the fan blade structure 100 provided in the embodiment of the present disclosure can generate a larger air volume at the same rotational speed, and requires a lower rotational speed when generating the same air volume, which improves the air volume and air outlet efficiency of the fan blade structure 100.

Figure 5:
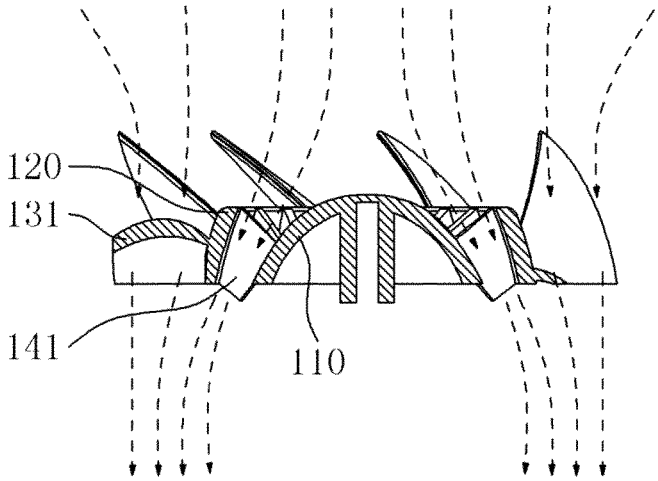
FIG. 5 is a cross-sectional view of air outlet of the combined fan blade structure in FIG. 1.

It needs to be noted that the airflow generated by the centrifugal blades has a larger pressure. After the airflow generated by the second blade set 140 is mixed with the airflow generated by the first blade set 130, the pressure of the mixed airflow can be increased. Therefore, the fan blade structure 100 is suitable for air outlet environments with high pressure and large air volume. In an embodiment of the present disclosure, as shown in FIG. 5, the outer hub 120 guides the radial airflow generated by the second blade set 140 axially, allowing the blade structure 100 to discharge airflow axially. This makes it applicable to axial flow fans, and increases the pressure of the combined airflow of the fan blade structure 100, which is beneficial to increasing the airflow speed of the fan blade structure 100.

In addition, the linear speed at the inner sides of the axial flow blades is usually smaller than that at the outer sides, making the airflow generated by the axial flow blades have slower inner airflow and faster outer airflow. In an embodiment of the present disclosure, by combining the first blade set 130 and the second blade set 140, and with no limitation on the number of second blades 141, a large air volume can be generated. The airflow generated by the second blade set 140 can make up for the insufficiency of linear speed at the inner side of the first blade set 130, making the airflow across the entire air outlet surface of the fan blade structure 100 more uniform.

Figure 2:
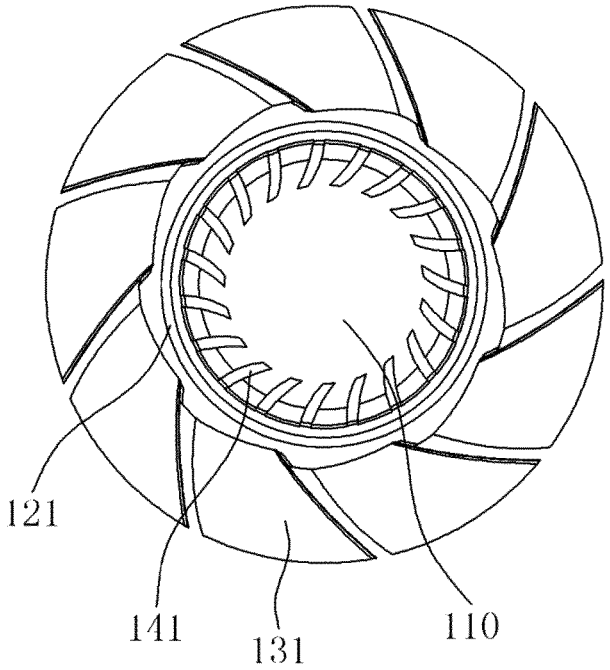
FIG. 2 is a top view of the combined fan blade structure in FIG. 1.
Figure 3:
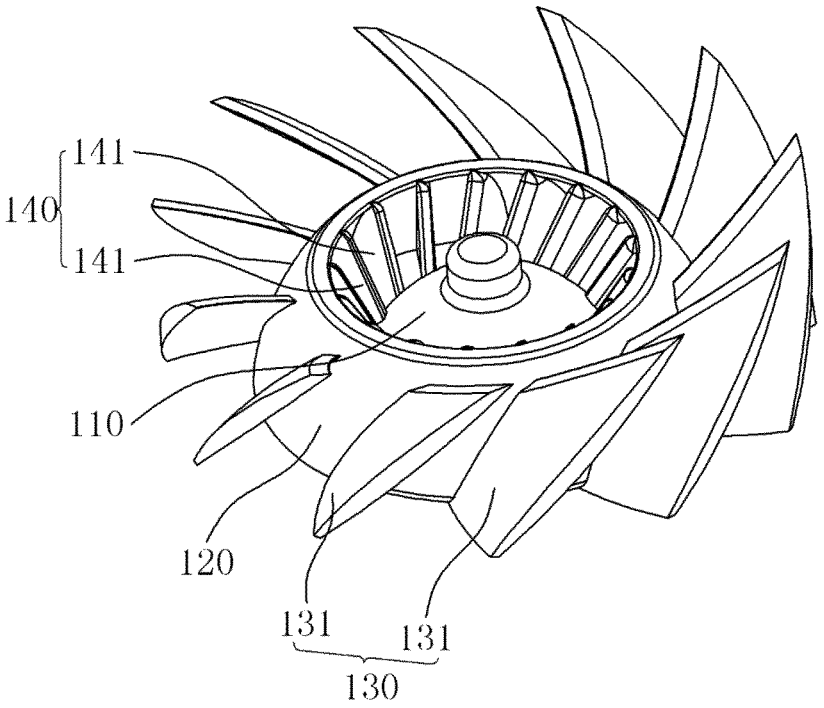
FIG. 3 is a schematic structural diagram of the combined fan blade structure according to other embodiments of the present disclosure.
Figure 4:
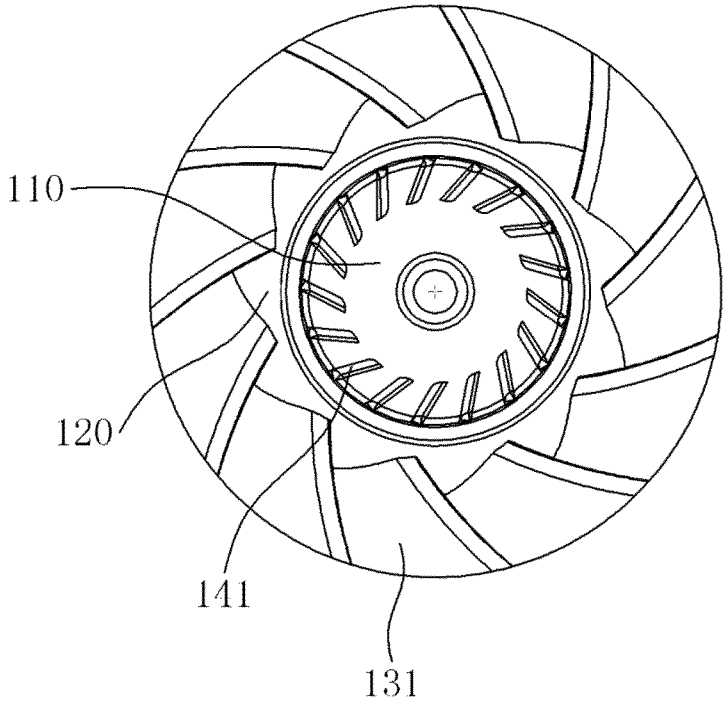
FIG. 4 is a top view of the combined fan blade structure in FIG. 3.

Referring to FIGS. 1 and 2, in some embodiments, the first blades 131 are axial flow blades. The first blade set 130 discharges air in the axial direction, the mixed airflow of the first blade set 130 and the second blade set 140 is discharged in the axial direction, and the fan blade structure 100 discharges the airflow in the axial direction, and is suitable for environments with axial air discharge requirements. Referring to FIGS. 3 and 4, in other embodiments, the first blades 131 are oblique flow blades. The first blade set 130 discharges air obliquely, the mixed airflow of the first blade set 130 and the second blade set 140 is discharged in the axial direction and oblique direction, and the fan blade structure 100 is suitable for environments with axial and oblique air discharge requirements.

As shown in FIG. 2, when the first blades 131 are axial flow blades, the projections of adjacent first blades 131 in the plane perpendicular to the axial direction do not overlap. In other words, the projections of adjacent first blades 131 in the plane perpendicular to the axial direction are circumferentially spaced. The fan blade structure 100 may be molded in the axial direction and integrally formed by means of injection molding, etc. The processing cost of the fan blade structure 100 is low, and the components do not need to be assembled, making it highly convenient to use. As shown in FIG. 4, when the first blades 131 are oblique flow blades, the projections of adjacent first blades 131 in the plane perpendicular to the axial direction have overlapping areas in the circumferential direction. This prevents axial molding of the fan blade structure 100, but sliding core molding (where a slider is used to form structures that cannot be directly parted) can be applied, and the structure can still be integrally formed using injection molding. Compared with configuring the first blades 131 as axial flow blades, the processing cost of the oblique flow blades is higher, but at the same rotational speed, the airflow generated has a larger air volume and pressure. Moreover, regardless of whether the first blades 131 are axial flow blades or oblique flow blades, the combination of the first blade set 130 and the second blade set 140 enables the fan blade structure 100 to produce high-volume, high-pressure airflow and ensures efficient air discharge.

As shown in FIG. 5, in the air outlet direction, the outer hub 120 is inclined in a direction away from the rotation axis of the inner hub 110, so that the outer hub 120 is inclined toward the outer side of the fan blade structure 100 compared to the central axis of the fan blade structure 100. In other words, the outer hub 120 has a gradually expanding structure in the air outlet direction. On the one hand, the second blades 141 are centrifugal blades, the airflow generated by the second blade set 140 flows in the radial direction of the fan blade structure 100, the inclined arrangement of the outer hub 120 can reduce the impact of the second blade set 140 on the outer hub 120, and the outer hub 120 can guide out the airflow generated by the second blade set 140 obliquely, so that the airflow can be more easily discharged from between the inner hub 110 and the outer hub 120, avoiding the turbulence or noise generated between the outer hub 120 and the inner hub 110. On the other hand, the airflow generated by the second blade set 140 is discharged obliquely outward, the airflow generated by the first blade set 130 flows axially, and the airflows generated by the two can be rapidly mixed, so that driven by the airflow generated by the second blade set 140, the flow rate of the mixed airflow can be increased.

In some embodiments, as shown in FIGS. 5 to 8, in the air outlet direction, the inner hub 110 is inclined in the direction away from the rotation axis of the inner hub 110. In other words, the inner hub 110 has a gradually expanding structure in the air outlet direction. Specifically, the inner hub 110 has only one opening facing the air outlet side. The inclined arrangement of the inner hub 110 is also conducive to the introduction of the airflow, and can increase the smoothness of the air intake and discharge of the fan blade structure 100 and avoid the turbulence or noise generated between the inner hub 110 and the outer hub 120.

Figure 6:
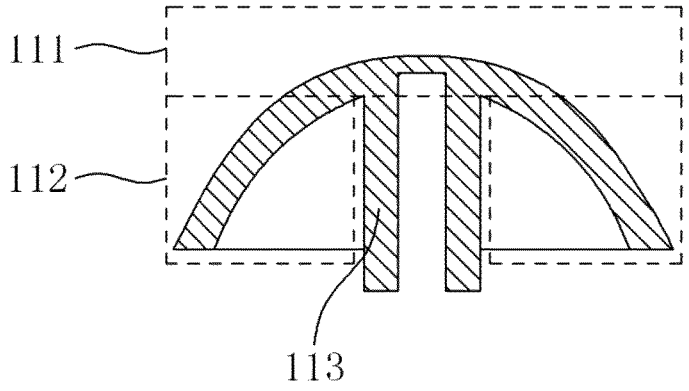
FIG. 6 is a schematic structural diagram of some embodiments of an inner hub in FIG. 5.

As shown in FIG. 6, the inner hub 110 has a first air guide portion 111 and a second air guide portion 112. The first air guide portion 111 and the second air guide portion 112 are integrally connected. The first air guide portion 111 is located on the air inlet side of the inner hub 110. The second air guide portion 112 is arranged opposite the outer hub 120 in the radial direction of the outer hub 120. Both sides of the second blades 141 are respectively connected to the inner side of the outer hub 120 and the outer side of the second air guide portion 112. Both the first air guide portion 111 and the second air guide portion 112 can guide the external air to allow the external air to enter between the inner hub 110 and the outer hub 120. In addition, the first air guide portion 111 may be connected to a power element, and the power element may provide power to the fan blade structure 100, so that the fan blade structure 100 generates an airflow.

Specifically, in some embodiments, the first air guide portion 111 is inclined in a direction away from the rotation axis of the inner hub 110, that is, the first air guide portion 111 is inclined from the air inlet side toward the air outlet side of the fan blade structure 100, and the size of the first air guide portion 111 in the radial direction of the outer hub 120 gradually increases. The first air guide portion 111 guides the air in the external environment, and rapidly guides the air entering the fan blade structure 100 to the outer circumference of the inner hub 110 and reach between the inner hub 110 and the outer hub 120, so that the air forms an airflow under the rotation of the second blade set 140, thereby improving the air outlet efficiency of the fan blade structure 100.

The cross section of the first air guide portion 111 in the axial direction of the fan blade structure 100 may be triangular or arc-shaped, that is, the first air guide portion 111 may be a cone surface, a spherical surface, etc., to achieve rapid air guidance. In some embodiments, the cross section of the first air guide portion 111 is arc-shaped, and the first air guide portion 111 and the second air guide portion 112 make a smooth transition at the connection point, so that the air can flow along the outer surface of the inner hub 110 to avoid the turbulence generated during the air flow, thereby reducing the noise of the fan blade structure 100.

Further, in the air outlet direction of the fan blade structure 100, the second air guide portion 112 is inclined in a direction away from the rotation axis of the inner hub 110, and the external air rapidly flows to the second air guide portion 112 under the guidance of the first air guide portion 111. The second air guide portion 112 leads the airflow generated by the second blade set 140 obliquely outward. Under the guidance of the second air guide portion 112, the airflow generated by the second blade set 140 can be rapidly mixed with the airflow generated by the first blade set 130. In addition, since the outer hub 120 and the second air guide portion 112 are both inclined toward the outer side of the fan blade structure 100, the oblique guide effect on the airflow generated by the second blade set 140 can be enhanced, facilitating the rapid mixing of the airflows from the first blade set 130 and the second blade set 140.

In some embodiments, in the air outlet direction, the acute angle between the first air guide portion 111 and the second air guide portion 112 and the rotation axis of the inner hub 110 gradually decreases, that is, the first air guide portion 111 and the second air guide portion 112 are smoothly connected to form an arc and both protrude in a direction away from the rotation axis, which is beneficial to the guidance of the airflow along the outer surface of the inner hub 110, and promotes the airflow generated by the second blade set 140 to be mixed with the airflow generated by the first blade set 130.

In some embodiments, the first air guide portion 111 is axially higher than the air inlet side of the outer hub 120, which can optimize the steering angle of the airflow in the middle portion of the second blade set 140, for example, increase the steering angle of the airflow at the air inlet side in the middle portion of the centrifugal fan blades. The first air guide portion 111 of this embodiment is axially higher than the air inlet side of the outer hub 120, which can strengthen the air guide effect and increase the smoothness of the air intake and discharge in the air duct between the inner hub 110 and the outer hub 120.

In some embodiments, the distance between adjacent second blades 141 in the inner circumferential direction of the outer hub 120 is smaller than that between adjacent first blades 131 in the outer circumferential direction of the outer hub 120, that is, the second blades 141 are arranged more densely than the first blades 131. Since the second blades 141 are centrifugal blades, the number of the second blades 141 and the size of the inner hub 110 are not limited by the hub ratio. By providing a larger number of second blades 141, the air volume of the second blade set 140 can be increased, thereby increasing the overall air volume of the fan blade structure 100. In addition, the hub ratio of the inner hub 110 to the second blades 141 is smaller than the hub ratio of the outer hub 120 to the first blades 131. Therefore, the second blade set 140 can generate airflow with larger air volume and pressure than the first blade set 130, so that compared with the traditional axial flow fan, the air volume and pressure of the fan blade structure 100 are effectively increased.

Figure 7:
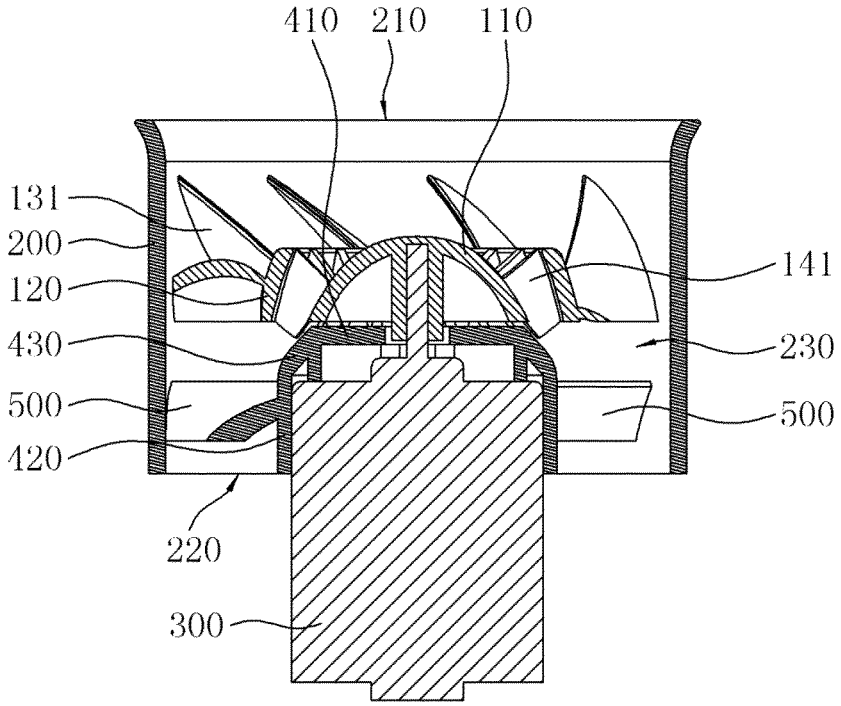
FIG. 7 is a cross-sectional view of an air outlet device according to some embodiments of the present disclosure.
Figure 8:
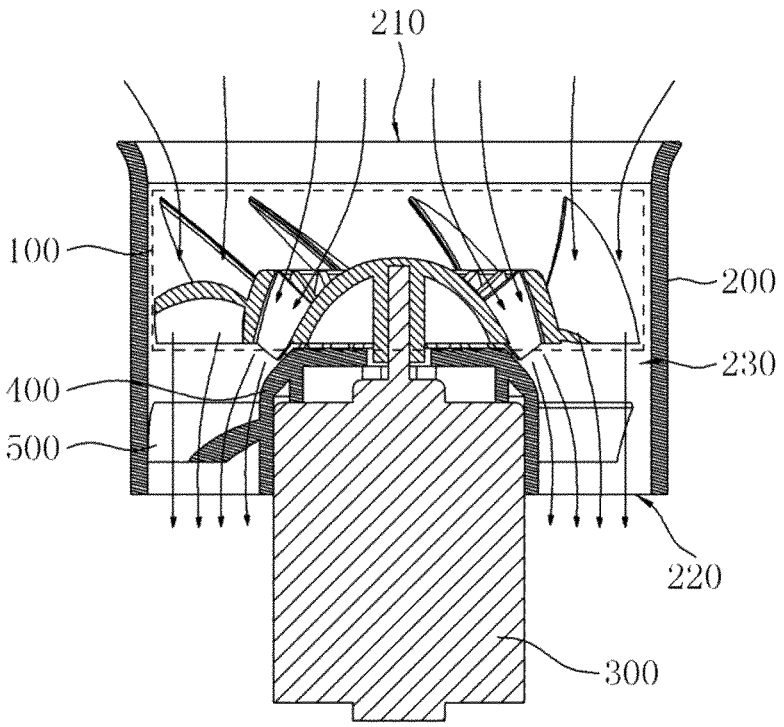
FIG. 8 is a schematic diagram of air flow of the air outlet device in FIG. 7.

Referring to FIGS. 7 and 8, an embodiment of the present disclosure further provides an air outlet device, including the above combined air outlet structure 100, and further including an air deflector 200 and a power element 300. The air deflector 200 is provided with an air inlet 210 and an air outlet 220 at both ends. The air deflector 200 has an air guide cavity 230 inside. The air inlet 210 and the air outlet 220 are both communicated with the air guide cavity 230. The combined fan blade structure 100 is accommodated in the air guide cavity 230 and coaxially arranged with the air deflector 200. External air enters the air guide cavity 230 from the air inlet 210. The power element 300 is connected to the end of the inner hub 110 close to the air outlet 200 and is configured to drive the inner hub 110 to rotate. The first blade set 130 and the second blade set 140 form an airflow during rotation. The air passes through the fan blade structure 100 to form an airflow and is discharged from the air outlet 220.

As shown in FIG. 8, the air deflector 200 is coaxially arranged with the inner hub 110 and the outer hub 120. The power element 300 is connected to the air outlet side of the fan blade structure 100 and is located at the center of the fan blade structure 100. Due to the guidance of the air deflector 200 and the power element 300, the airflow discharged from the air outlet 220 by the air outlet device is distributed in an annular area and is discharged in the axial direction of the air deflector 200. Constrained by the air deflector 200 and the power element 300, the airflow of the air outlet device has good linearity, which is suitable for environments with axial air outlet and fixed area air supply.

Figure 9:
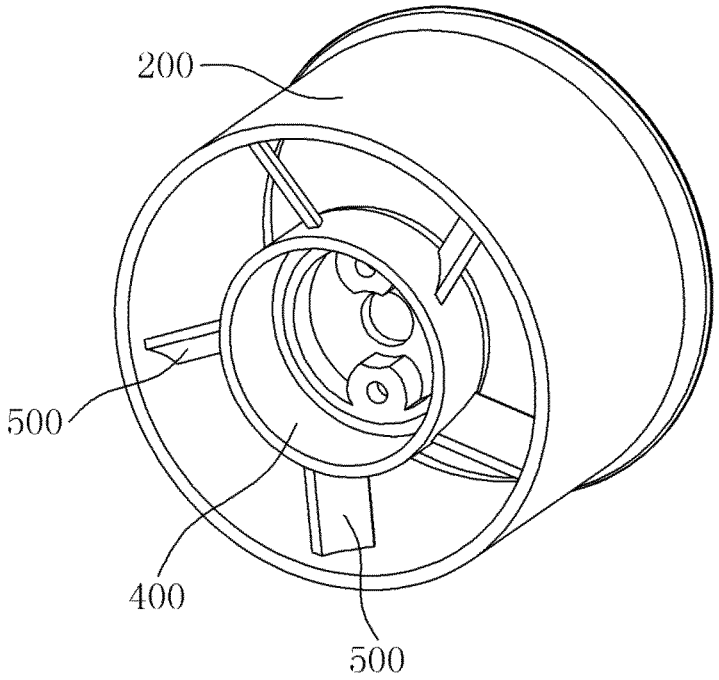
FIG. 9 is a three-dimensional view of the air outlet device in FIG. 7.

As shown in FIGS. 7 and 9, the air outlet device further includes a mounting seat 400 and a plurality of guide vanes 500. The mounting seat 400 and the plurality of guide vanes 500 are all accommodated in the air deflector 200. The mounting seat 400 and the air deflector 200 are coaxially arranged. One end of the mounting seat 400 is connected to the inner hub 110, and one end of the power element 300 connected to the inner hub 110 passes through the mounting seat 400. The mounting seat 400 is configured to support and install the power element 300. The plurality of guide vanes 500 are arranged around the outer periphery of the mounting seat 400. Both radial sides of the guide vanes 500 are respectively connected to the air deflector 200 and the mounting seat 400. The guide vanes 500 serve to connect the air deflector 200 with the mounting seat 400 and to guide the airflow, so as to improve the coaxiality of the mounting seat 400 with the air deflector 200 and the overall structural strength of the mounting seat 400 and the air deflector 200, and make the airflow in the air guide cavity 230 discharged in the axial direction of the air deflector 200.

Furthermore, the plurality of guide vanes 500 are evenly distributed in the circumferential direction of the mounting seat 400. By guiding the airflow in the air guide cavity 230 by the guide vanes 500, the uniformity of the airflow at the air outlet 220 can be improved. Optionally, the air deflector 200 is flared at one end of the air inlet 210 to facilitate external air to enter the air guide cavity 230.

Specifically, the mounting seat 400 includes a first connecting part 410 and a second connecting part 420. The first connecting part 410 is perpendicular to the rotation axis of the inner hub 110, and the second connecting part 420 is annular and connected to the outer periphery of the first connecting part 410. The first connecting part 410 abuts against the power element 300, and the second connecting part 420 is connected to the guide vanes 500. Specifically, as shown in FIGS. 6 and 7, the inner hub 110 includes a mounting part 113 connected to the inner side of the first air guide portion 111. The first connecting part 410 has a through hole for the output end of the power element 300 to pass through. The output end of the power element 300 is inserted into the mounting part 113 to realize power transmission from the power element 300 to the inner hub 110.

In addition, in the radial direction of the outer hub 120, the outer wall of the mounting seat 400 is located on the inner side of the inner wall of the outer hub 120 at one end close to the air outlet 220, so as to prevent the mounting seat 400 from blocking the air discharge of the second blade set 140. The mounting seat 400 further includes a transition part 430. Both ends of the transition part 430 are connected to the first connecting part 410 and the second connecting part 420, respectively. In the air outlet direction, the transition part 430 is inclined in a direction away from the rotation axis of the inner hub 110. The transition part 430 serves to guide the airflow discharged from the fan blade structure 100, and guide the airflow between the second connecting part 420 and the air deflector 200, so that the airflow is discharged in the axial direction of the air deflector 200.

The embodiments of the present disclosure are described in detail above in combination with the drawings, but the present disclosure is not limited to the above embodiments. On the premise of not departing from the purpose of the present disclosure, various changes may also be made within the knowledge scope of those of ordinary skills in the art. In addition, the embodiments in the present disclosure and features in the embodiments may be combined with each other without conflict.

What is claimed is:

1. A combined fan blade structure, comprising:

an inner hub;

an outer hub coaxially arranged with the inner hub and arranged around the inner hub;

a first blade set connected to an outer peripheral surface of the outer hub, wherein the first blade set comprises a plurality of first blades, and the plurality of first blades are distributed at intervals in a circumferential direction of the outer hub; and a second blade set connected between the inner hub and the outer hub, wherein the second blade set comprises a plurality of second blades, the plurality of second blades are distributed at intervals in a circumferential direction of the inner hub, and the outer hub blocks sides of the second blades facing the outer hub, wherein the outer hub has a radially inner surface and a radially outer surface inclined in a direction away from a rotation axis of the inner hub in an air outlet direction, the radially inner surface and the radially outer surface are nonparallel.

2. The combined fan blade structure according to claim 1, wherein the first blades comprise axial flow blades or oblique flow blades, and/or the second blades comprise centrifugal blades.

3. The combined fan blade structure according to claim 1, wherein the first blades are axial flow blades, and projections of adjacent first blades in a plane perpendicular to an axial direction are spaced in the circumferential direction of the outer hub;

or, the first blades are oblique flow blades, and projections of adjacent first blades in a plane perpendicular to an axial direction have overlapping areas in the circumferential direction of the outer hub.

4. The combined fan blade structure according to claim 1, wherein the inner hub is inclined in a direction away from a rotation axis of the inner hub in an air outlet direction.

5. The combined fan blade structure according to claim 1, wherein the inner hub has an opening facing an air outlet side.

6. The combined fan blade structure according to claim 1, wherein the inner hub comprises a first air guide portion and a second air guide portion connected to each other, the first air guide portion is located on an air inlet side of the inner hub, the second air guide portion is arranged opposite the outer hub in a radial direction of the outer hub, and the second blades are connected to the second air guide portion.

7. The combined fan blade structure according to claim 6, wherein the first air guide portion and/or the second air guide portion are inclined in a direction away from a rotation axis of the inner hub in an air outlet direction.

8. The combined fan blade structure according to claim 6, wherein an acute angle between the first air guide portion and the second air guide portion and a rotation axis of the inner hub gradually decreases in an air outlet direction.

9. The combined fan blade structure according to claim 6, wherein the first air guide portion is axially higher than an air inlet side of the outer hub.

10. The combined fan blade structure according to claim 1, wherein a distance between adjacent second blades in an inner circumferential direction of the outer hub is smaller than a distance between adjacent first blades in an outer circumferential direction of the outer hub.

11. The combined fan blade structure according to claim 1, wherein a hub ratio of the inner hub to the second blades is smaller than a hub ratio of the outer hub to the first blades.

12. An air outlet device, comprising:

the combined fan blade structure according to claim 1;

an air deflector provided with an air inlet and an air outlet at both ends, wherein the air deflector has an air guide cavity inside, the air inlet and the air outlet are both communicated with the air guide cavity, and the combined fan blade structure is accommodated in the air guide cavity and coaxially arranged with the air deflector; and a power element connected to one end of the inner hub close to the air outlet and configured to drive the inner hub to rotate.

13. The air outlet device according to claim 12, further comprising a mounting seat and a plurality of guide vanes, wherein the mounting seat and the plurality of guide vanes are all accommodated in the air deflector, the mounting seat and the air deflector are coaxially arranged, one end of the power element connected to the inner hub passes through the mounting seat, the plurality of guide vanes are arranged around an outer periphery of the mounting seat, and the guide vanes are connected between the air deflector and the mounting seat.

14. The air outlet device according to claim 13, wherein an outer wall of the mounting seat is located radially inward of an inner wall of the outer hub at one end adjacent to the air outlet.

15. The air outlet device according to claim 13, wherein the mounting seat comprises a first connecting part, a second connecting part, and a transition part, the first connecting part is perpendicular to a rotation axis of the inner hub, the second connecting part is arranged around an outer periphery of the first connecting part, the transition part is connected between the first connecting part and the second connecting part, and the transition part is inclined away from the rotation axis of the inner hub in an air outlet direction.

* * * * *